US010150603B2

(12) United States Patent
Sheldon et al.

(10) Patent No.: US 10,150,603 B2
(45) Date of Patent: Dec. 11, 2018

(54) PACKAGE FOR DELIVERY OF ADDITIVES FOR POWDERED COMPOSITIONS

(71) Applicant: UNITED STATES GYPSUM COMPANY, Chicago, IL (US)

(72) Inventors: Joshua D. Sheldon, Chicago, IL (US); Nancy L. Bernicke-Grussing, Trevor, WI (US); Jeffrey F. Grussing, Trevor, WI (US); Salvatore C. Immordino, Jr., Trevor, WI (US); Tyler Kincaid, Chicago, IL (US); Charles Miller, Johnsburg, IL (US)

(73) Assignee: UNITED STATES GYPSUM COMPANY, Chicago, IL (US)

( * ) Notice: Subject to any disclaimer, the term of this patent is extended or adjusted under 35 U.S.C. 154(b) by 0 days.

(21) Appl. No.: 15/362,403

(22) Filed: Nov. 28, 2016

(65) Prior Publication Data

US 2017/0073143 A1 Mar. 16, 2017

Related U.S. Application Data

(63) Continuation-in-part of application No. 14/856,333, filed on Sep. 16, 2015, now Pat. No. 9,944,443.
(Continued)

(51) Int. Cl.

| | |
|---|---|
| ***B65D 81/32*** | (2006.01) |
| ***B65D 65/46*** | (2006.01) |
| ***B65D 51/28*** | (2006.01) |

(52) U.S. Cl.
CPC ..... *B65D 65/46* (2013.01); *B65D 51/28* (2013.01); *B65D 51/2821* (2013.01); *B65D 51/2842* (2013.01); *B65D 81/3205* (2013.01)

(58) Field of Classification Search
CPC ..... B65D 51/28; B65D 81/3216; B65D 51/2828; B65D 81/3222; B65D 51/2814; B65D 51/2821
(Continued)

(56) References Cited

U.S. PATENT DOCUMENTS

| | | | |
|---|---|---|---|
| 2,756,875 | A | 7/1956 | Yochim |
| 3,074,544 | A | 1/1963 | Bollmeier et al. |

(Continued)

FOREIGN PATENT DOCUMENTS

| | | | |
|---|---|---|---|
| CN | 201334188 | Y | 10/2009 |
| CN | 201525562 | U | 7/2010 |

(Continued)

OTHER PUBLICATIONS

International Search Report from International Patent Application No. PCT/US2016/012034 corresponding to U.S. Appl. No. 14/856,333, dated Mar. 31, 2016.

(Continued)

*Primary Examiner* — Chun Cheung
(74) *Attorney, Agent, or Firm* — Greer, Burns & Crain, Ltd.; Pradip Sahu; Philip T. Petti

(57) ABSTRACT

A joint compound system is provided including a main container of base joint compound; and an additive container isolated from the base joint compound and housing at least one and preferably multiple additive packages constructed and arranged so that the additive packages are protected from exposure to moisture prior to their ultimate mixing with the base joint compound.

14 Claims, 6 Drawing Sheets

Related U.S. Application Data

(60) Provisional application No. 62/099,798, filed on Jan. 5, 2015.

(58) Field of Classification Search
USPC ..... 206/321, 219, 222; 220/521
See application file for complete search history.

(56) References Cited

U.S. PATENT DOCUMENTS

| | | | | |
|---|---|---|---|---|
| 3,326,363 | A * | 6/1967 | Bennett | B65D 51/28 206/219 |
| 3,580,390 | A | 5/1971 | Shull, Jr. | |
| 3,796,813 | A * | 3/1974 | Kurland | B65D 51/28 206/219 |
| 4,509,642 | A | 4/1985 | Rowell | |
| 4,557,377 | A | 12/1985 | Maloney | |
| 4,972,017 | A * | 11/1990 | Smith | C11D 17/042 510/296 |
| 5,052,553 | A * | 10/1991 | De Sanctis | B65D 51/2814 206/219 |
| 5,494,190 | A | 2/1996 | Boettcher | |
| 5,673,789 | A * | 10/1997 | Degraff-Eugene | A47G 19/2205 206/217 |
| 6,547,064 | B2 | 4/2003 | Klair | |
| 6,695,901 | B2 | 2/2004 | Diesso | |
| 7,270,233 | B2 | 9/2007 | Kindt | |
| 8,668,087 | B2 * | 3/2014 | Hargrove | B65D 77/08 206/447 |
| 2004/0109384 | A1 | 6/2004 | Dewinter | |
| 2005/0178677 | A1 * | 8/2005 | Morrow | B65D 51/28 206/219 |
| 2006/0118434 | A1 | 6/2006 | Leiner et al. | |
| 2007/0017831 | A1 * | 1/2007 | Kindt | B65D 51/28 206/219 |
| 2007/0217971 | A1 | 9/2007 | Michalsky et al. | |
| 2008/0000898 | A1 | 1/2008 | Ramsden | |
| 2011/0100844 | A1 * | 5/2011 | Cimaglio | B65D 81/3266 206/219 |
| 2016/0194124 | A1 | 7/2016 | Sheldon et al. | |

FOREIGN PATENT DOCUMENTS

| | | | |
|---|---|---|---|
| CN | 203698984 | U | 7/2014 |
| DE | 1482523 | A1 | 4/1969 |
| DE | 8622124 | U1 | 1/1987 |
| DE | 19523803 | A1 | 1/1997 |
| DE | 202004012123 | U1 | 10/2004 |
| DE | 102007045299 | A1 | 4/2009 |

OTHER PUBLICATIONS

International Search Report from corresponding International Patent Application No. PCT/US2017/062995, dated Feb. 28, 2018.
Chinese Office Action from Chinese Patent Application No. 2016800004393.0, dated Sep. 13, 2018.

* cited by examiner

PACKAGE FOR DELIVERY OF ADDITIVES FOR POWDERED COMPOSITIONS

RELATED APPLICATIONS

The present application is a Continuation-In-Part of U.S. Ser. No. 14/856,333 filed Sep. 16, 2015, which claims Section 119(e) priority from U.S. Provisional Ser. No. 62/099,798 filed Jan. 5, 2015.

BACKGROUND

The present invention relates generally to multi-component powdered compositions, and more specifically to packaged additives for settable powder compositions such as, but not limited to wallboard joint compound.

Walls and ceilings made from gypsum wallboard are conventionally constructed by attaching the wallboard panels to framing members or studs, and filling and coating the joints between the panels with a specially formulated paste composition called a joint compound. Joint compounds may be supplied as powdered compositions (to be mixed with water at the jobsite) or may be premixed with water at the factory to yield a ready mixed (or paste) joint compound. A paste joint compound (Taping grade) is placed within and over the joint formed by the abutting edges of the wallboard panels, and a paper reinforcing tape is embedded in the joint with the joint compound which is then permitted to dry. Alternately, the reinforcing tape may be of non-cellulose composition, but of a size and shape similar to strips of paper joint tape. Alternately, the reinforcing tape may be of a fiberglass weave requiring the use of chemically setting type joint compounds. When the joint compound is dry, a second joint compound (Topping or Finishing grade) is applied over the joint, and it too is permitted to dry. It is usually necessary for a third application of a joint compound and, after the third coat is dry, it may be lightly sanded and may be conventionally finished with a decorative material (paint, texture or wallpaper) then applied to the wall. All three coats of joint compound may alternately be applied with an All Purpose grade of joint compound.

There are several categories of joint compounds. Drying type compounds harden through the evaporation of water, whereas setting type joint compounds chemically react with water during the curing process. Setting type joint compounds typically use calcium sulfate hemihydrate, also known as stucco or plaster of Paris, as a base. When water is added to the setting type powder, it reacts with the calcium sulfate hemihydrate via a hydration reaction to form an interlocking matrix of calcium sulfate dihydrate crystals. The interlocking crystal matrix gives the compound increased strength. The benefit of a setting type joint compound over a drying type is the overall strength of the finished joint, resulting in less shrinking and cracking, as well as an independence from having to wait for the joint compound to be completely dry prior to further finishing. Drying type joint compounds have the advantage of ease of use, as they typically come in a ready mixed form, with water being added and mixed by the manufacturer. A third type of joint compound combines the setting action of a calcium sulfate hemihydrate based compound with the ease of use of a ready mixed compound.

Ready mixed joint compound is typically supplied to the customer in either cardboard cartons or plastic pails in units having volumes of 3.5 to 4.5 gallons (13.25-17.03 L). Joint compound is supplied at a viscosity typically higher than what is applied at the jobsite. This allows the contractor to mix in additional water using a power drill and mixing paddle to achieve the desired application viscosity.

Ready Mix joint compound production is typically accomplished by blending the wet and dry ingredients in a mixer until smooth, adjusting the viscosity to a desired level through water addition, then filling and sealing containers to be shipped to customers. This process can be disrupted by use of ingredients which thicken very rapidly and take longer periods of time to fully wet out and drop in viscosity, leaving the combined wet and dry ingredients in the mixer competing for water through the typical mixing cycle and at a higher than desired viscosity. The above process results in mechanical limitations and problems such as binding of the wet mixer and overloading of the mixer motor. The higher than desired viscosity at the completion of the mixing cycle affects the ease of pumping and moving the material out of the mixing system and through the packaging line and also interferes with the lidding and closing of the container.

It is known to provide selective performance enhancing additives to the joint compound mixture during formulation at the jobsite to enhance performance characteristics. In some cases, the set or dry time is accelerated, in others retarded. Also, viscosity and/or dust generation during sanding are characteristics that are influenced by additives to the mixture. Thus, there are mechanical limitations on the types of raw materials that can be used within a typical wet mixing system for manufacturing ready mix. Depending on the particular product requirements, including long pre-use shelf life, fast setting, low viscosity of application and others, several options have been proposed to provide joint compounds with separated additives that enable the user to obtain enhanced or more desirable joint compound performance characteristics when the mixture is finalized just prior to application.

U.S. Pat. No. 6,476,099, incorporated by reference, discloses the addition of surfactant additives to joint compound to generate performance with improved cracking, improved shrinkage and reduction of surface finish defects after application to wallboard surfaces. U.S. Pat. Nos. 6,228,163 and 5,746,822 incorporated by reference, disclose joint compounds formulated with a base joint compound that is relatively inert until an extra additive is provided, functionally serving as an activator.

U.S. Pat. No. 8,822,566, incorporated by reference, discloses providing a nonhomogeneous formulation of an additive with a ready mix base joint compound for ultimate mixing by the user on the jobsite. There is an ongoing need for providing additives in a format that enables the user to adjust the operational characteristics of the joint compound to suit the particular situation.

SUMMARY

The above-identified need is met with the present additive packaging system, including providing separately packaged additives for use with a base joint compound or other powder or settable composition in a main container, so that the user can adjust the properties of the joint compound or desired composition during mixing. In the preferred embodiment, small flexible packages in the form of a tear pouch or stick pack contain designated amounts of additives for drywall finishing products that allows the user to add an additive to achieve a desirable trait or characteristic in the resulting joint compound. This packaging allows for pre-portioned, small amounts of additives that can be easily distributed to a consumer that allows them to add the additive to a drywall finishing product such as a joint compound, drywall patching compound, plaster, etc. In order to achieve any desirable trait. The preferred additives provided in the present package include, but are not limited to tint, de-dusting agents, binders, pigments, adhesion promoters, activators, accelerators, retarders, thickeners, and the like, as are known in the art.

In one embodiment, the individual additive packages are water soluble, so that upon the user dropping the package into the main container of base joint compound, the package dissolves and becomes part of the mixture. It is also contemplated that a separate package is provided containing a complete formulated joint compound in powdered formulation. A preferred material for the package is water soluble polyvinyl alcohol; however other water soluble plastics are contemplated, provided that they are completely soluble in water at room temperature. The state of the packaged additive may be liquid, solid or powder.

Another feature of the present system is that the additives are provided in relatively small volume doses for users desiring small batches of joint compound for use in small wall repair jobs or the like. Still another feature of the present system is that multiple, relatively small volume packages of the same additive are also contemplated. For example, in the case of an accelerator, for a given batch size of joint compound, the user adds multiple packages of the accelerator for obtaining relatively faster setting of the completed, mixed joint compound.

The present system includes a main container of base joint compound, which is either powder or ready mix. In addition, a separate container houses at least one and preferably multiple water soluble additive packages so that the additive packages are protected from exposure to moisture prior to their ultimate mixing. Also included in the present system is a flexible package containing a supply of additive.

DETAILED DESCRIPTION

Figure 1:
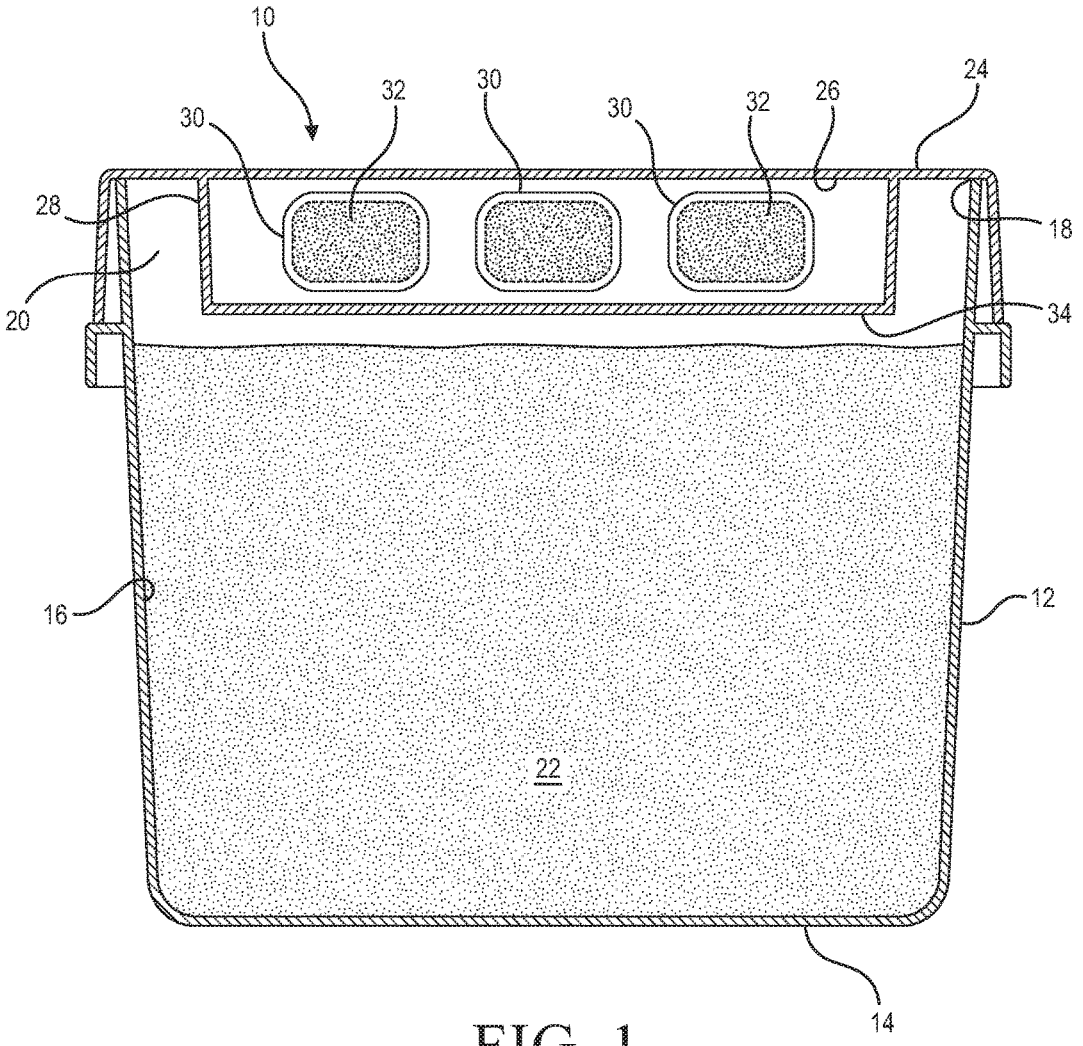
FIG. 1 is a vertical cross-section of the present additive system.
Figure 2:
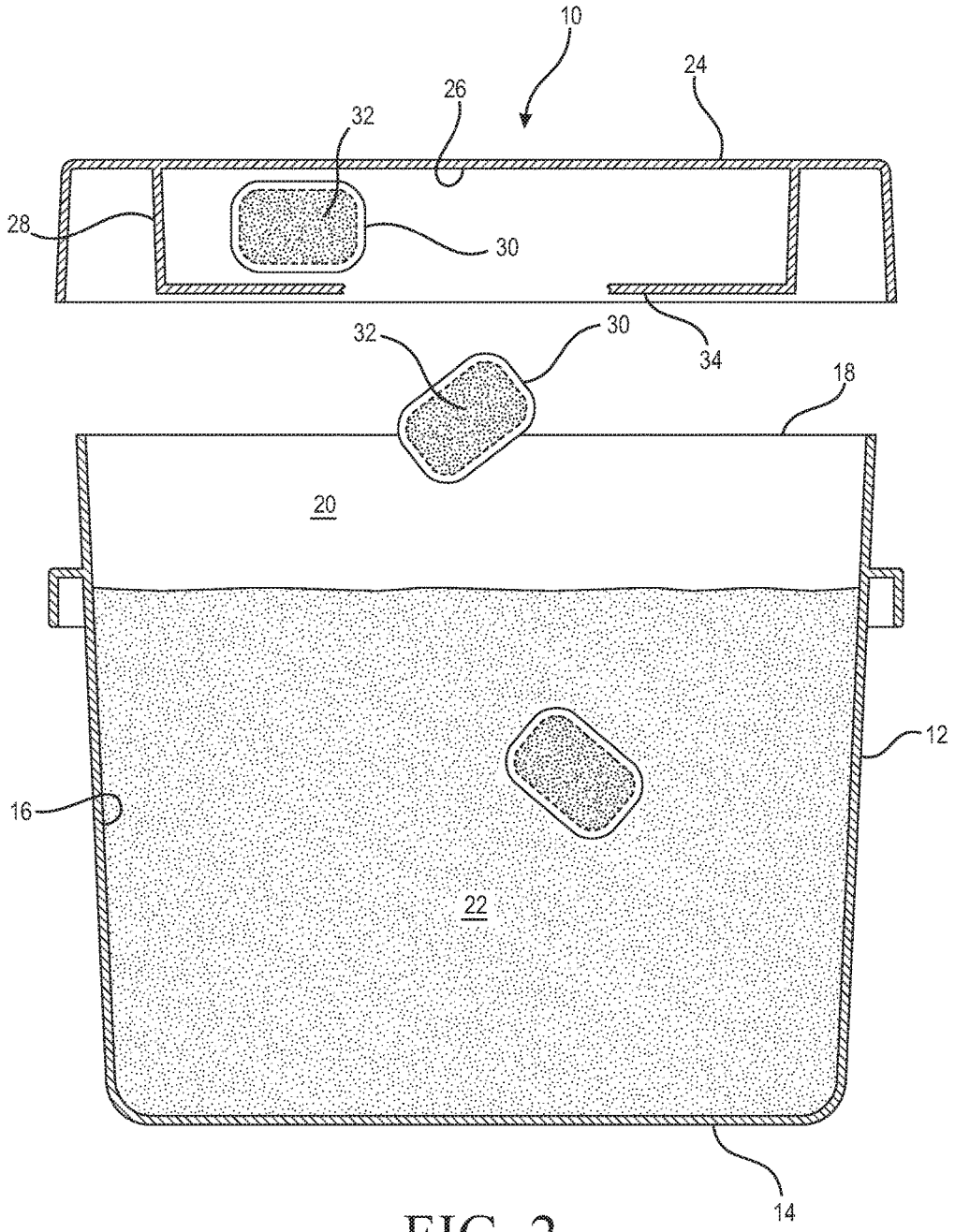
FIG. 2 is an exploded vertical cross-section of the present system, showing additive packages being added to a main joint compound container.
Figure 3:
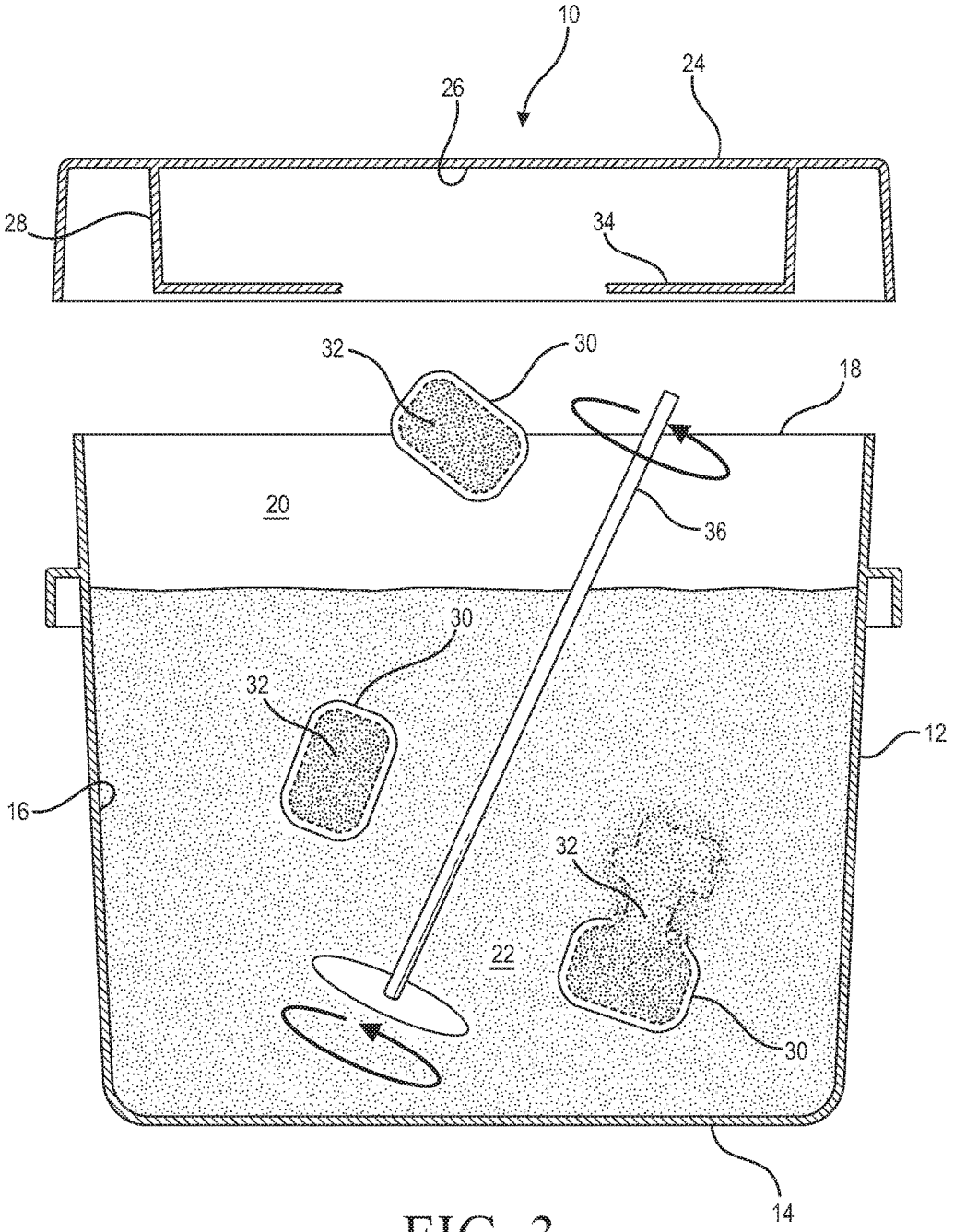
FIG. 3 is an exploded vertical cross-section of the present system, showing the additive packages being mixed into the joint compound.

Referring to FIGS. 1-3, the present water soluble additive system is shown, generally designated 10 and includes separately packaged additives for use with a base joint compound or other powder or settable composition in a main container, so that the user can adjust the properties of the joint compound or desired composition during mixing. More specifically, a main container 12 is typically a plastic bucket or tub of the type used to package ready mix wallboard joint compound, and includes a bottom 14, an annular sidewall 16 and an upper lip 18, all integrally formed, as by being made of molded plastic, and combining to define an internal chamber 20. Other materials are contemplated for the container 12, including but not limited to metal and cardboard. A supply of ready mix joint compound 22 substantially fills the internal chamber 20. While in the preferred embodiment, the base joint compound 22 is the ready mix type, it is also contemplated that powder or setting type joint compound is suitable.

The internal chamber 20 is covered by a removable container lid 24 that engages the upper lip 18 and latches closed upon the main container 12 using plastic clips or connectors (not shown) on the exterior of the container as are well known in the art. A feature of the present system 10 is that an underside 26 of the container lid 24 is provided with a compartment or additive container 28 constructed and arranged to retain at least one and preferably a plurality of individual additive packages 30. The additive container 28 is preferably made of the same material as the lid 24 and is configured so that prior to use, the additive packages 30 are isolated from the base joint compound 22, as well as from the internal chamber 20, and are protected from exposure to moisture prior to the ultimate mixing of the additive packages with the joint compound 22.

Contemplated additives 32 suitable for separate packaging in the present water soluble additive packages 30 include, but are not limited to retarders, accelerators, activators, dust reducers, pigments, adhesion promoters such as powdered adhesive, including polyvinyl alcohol or polyvinyl acetate and the like. The state of the packaged additive 32 is contemplated to be liquid, solid or powder.

A lower wall 34 of the additive container 28 is frangible, as by scoring, perforations, having a thinner wall thickness, or the like. Thus, when the user of the joint compound 22 in the main container 12 is ready to apply the joint compound, the frangible wall 34 is easily breached by the user using a taping knife or similar tool, and once the wall is breached, the additive packages 30 drop into the joint compound 22 (FIG. 2).

Figure 6:
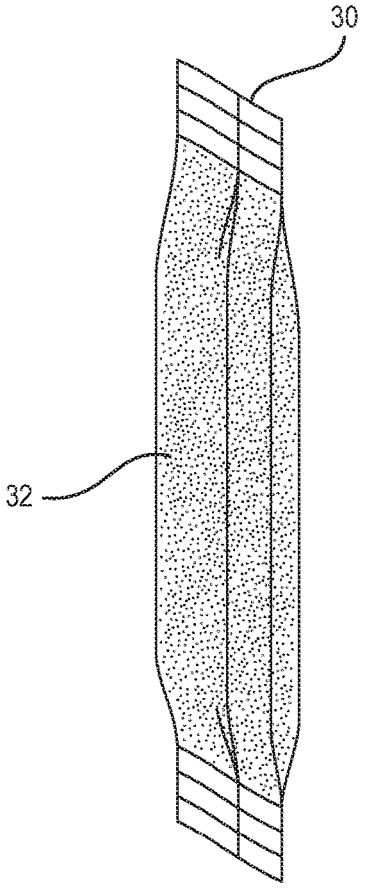
FIG. 6 is a flexible package suitable for use with the present system.

In one embodiment, the additive packages 30 are water soluble, and the joint compound is the ready mix type, which means that it is a moist paste when the container 12 is opened. A preferred material for the package 30 is water soluble polyvinyl alcohol; however other water soluble plastics are contemplated, provided that they are completely soluble in water at room temperature. Once the packages 30 are dropped or placed into the joint compound 22 into the main container 12, the packages dissolve and become part of the mixture. As seen in FIG. 3, it is contemplated that a powered mixer 36 is used for completely mixing the contents. Referring now to FIG. 6, it is contemplated that the package 30 is made of water insoluble material and is provided in at least one of a narrow rectangular shape referred to as a "stick" pack, and a relatively square or circular shaped pouch that is torn open by the user and the additive 32 mixed with the base joint compound 22.

Another feature of the present system 10 is that the additive packages 30 are provided in relatively small volume doses for users desiring small batches of joint compound for use in small wall repair jobs or the like. Preferably, the additive packages 30 contain additive 32 in the range of 5 to 20 grams. More preferably, the packages 30 contain additive in the range of 10 grams.

In addition, it is contemplated that a complete formulated joint compound in powdered format is packaged within one of the packages 30. Such a container 30 is optionally provided in a variety of volumes, including, but not limited to 1 pound packages.

Still another feature of the present system is that multiple, relatively small volume packages 30 of the same additive 32 are also contemplated. For example, in the case of an accelerator, for a given batch size of joint compound 22, the user adds multiple packages 30 of the accelerator for obtaining relatively faster setting of the completed, mixed joint compound 22.

Figure 4:
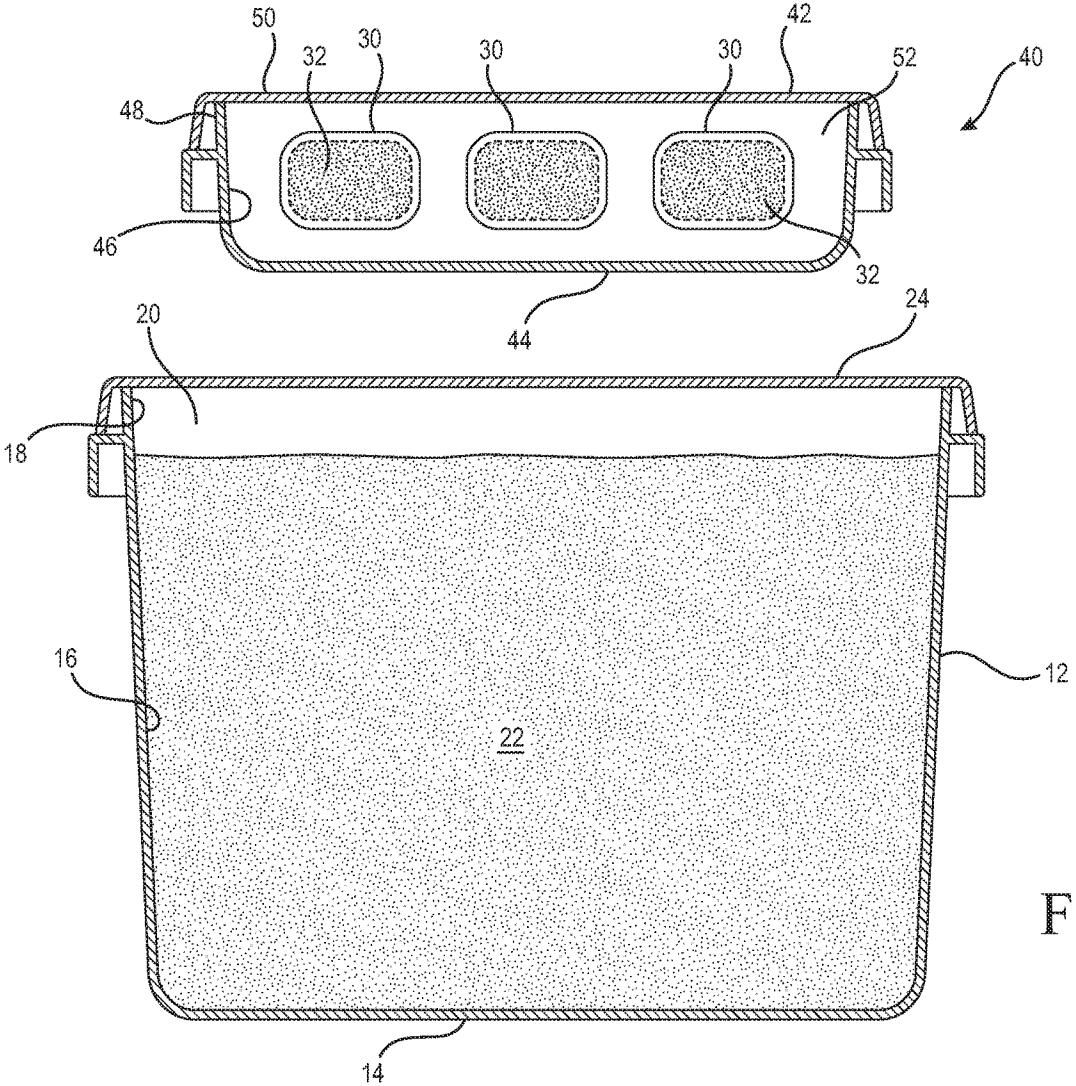
FIG. 4 is a vertical cross-section of an alternate embodiment of the present additive system using a separate container for the additive packages.
Figure 5:
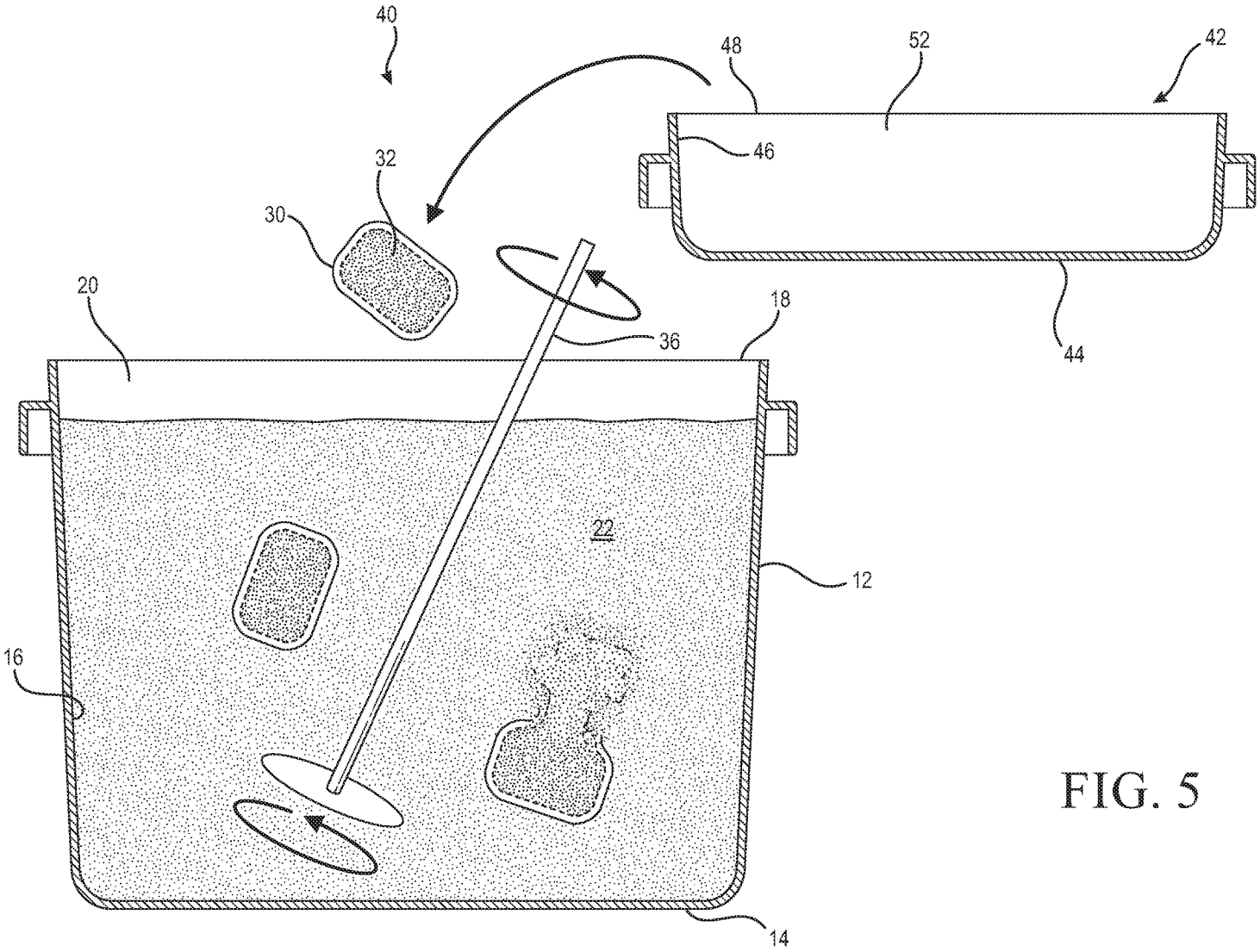
FIG. 5 is a vertical cross section of the embodiment of FIG. 4 showing the additive packages being mixed into the main joint compound container.

Referring now to FIGS. 4 and 5, another embodiment of the present joint compound additive system 10 is generally designated 40. Components shared with the system 10 are designated with identical reference numbers. A main distinctive feature of the system 40 is that the additive packages 30 are secured within a designated additive container 42 which is separate and isolated from the main container 12. The additive packages 30 in the system 40 have the same characteristics as in the system 10.

In the additive container 42, the packages 30, when provided in a water soluble format, are prevented from being exposed to moisture, which would cause them to prematurely dissolve and release the additive 32. As is the case with the main container 12, the additive container 42 includes a bottom 44, an annular wall 46 and an upper lip 48, all preferably integrally joined, as by being made of molded plastic. A lid 50 covers the upper lip 48 and encloses an additive cavity 52 that encloses the additive packages 30 and retains the additive 32 in inactive status until it is needed for use.

As seen in FIG. 5, once the operator needs to incorporate the additive 32 into the joint compound 22, the additive container 42 is opened and the at least one and preferably a plurality of additive packages 30 are deposited into the main container 12, where the packages 30 are dissolved and the additive 32 is mixed into the main joint compound 22. Preferably, the powered mixer 36 is used as needed. When using the water insoluble package of FIG. 6, the user tears or cuts open the package 30 and manually empties the additive 30 into the base joint compound 22, where the additive is mixed in as is known in the art.

In use, including the system 10 or the system 40, the user places a water soluble additive package 30 into the main container 12, and adds sufficient water to dissolve the package in water to mix with the packaged powder or ready mixed joint compound 22 to achieve the desired joint compound. Several of such packages 30 or pods are contemplated as being provided in the sealed container 28 or 42, thus reducing the mess and dust generated while mixing conventional powder-based, setting type joint compounds.

While a particular embodiment of the present package for delivery of additives for powdered compositions has been described herein, it will be appreciated by those skilled in the art that changes and modifications may be made thereto without departing from the invention in its broader aspects and as set forth in the following claims.

The invention claimed is:

1. A joint compound system, comprising:

a main container including a wall;

a joint compound stored in said main container; and a lid including a top wall, an inner wall and an outer wall, said inner wall and said outer wall depending from said top wall such that said top wall has a substantially flat top surface, said outer wall configured to form a seal with said main container, and said inner wall forming an additive container isolated from said base joint compound, said additive container being spaced from said wall of said main container and housing multiple, water insoluble, individually sealed additive packages including drywall finishing additives, said additive packages constructed and arranged so that the additive packages are protected from exposure to moisture prior to their ultimate mixing with said base joint compound, wherein one or more of the additive packages are opened and contents of said one or more additive packages added to the main container.

2. The system of claim 1, in which said base joint compound is either powder or ready mix.

3. The system of claim 1, in which said additive container is located on an underside of said lid.

4. The system of claim 1, in which said additive container is provided with a frangible wall.

5. The system of claim 1, in which said additive is taken from the group consisting of retarders, accelerators, activators, pigments, adhesion promoters and dust reducers.

6. The system of claim 5, wherein, each said package containing one of the same or different additives as the other said packages in said plurality.

7. The system of claim 1, in which said additive packages contain additive in the range of 5 to 20 grams.

8. The system of claim 7, wherein said additive packages contain 10 grams of additive.

9. The system of claim 1, wherein said additive package contains a complete joint compound.

10. A joint compound system, comprising:

a main container of base joint compound; and a lid attached to said main container, said lid having a substantially flat top surface and including a separate container depending from said lid that is distinct from said main container and houses multiple water insoluble, individually sealed additive packages constructed and arranged so that the additive packages are protected from exposure to moisture prior to their ultimate mixing with said base joint compound, wherein a plurality of said additive packages are opened and contents of said plurality of additive packages are added to the main container.

11. The system of claim 10, in which said additive is taken from the group consisting of retarders, accelerators, activators, pigments, adhesion promoters, and dust reducers.

12. The system of claim 11, wherein each said package containing one of the same or different additives as the other said packages in said plurality.

13. The system of claim 10, in which said additive packages contain additive in the range of 5 to 20 grams.

14. The system of claim 13, wherein said additive packages contain 10 grams of additive.

* * * * *